United States Patent [19]

Dawson, Jr. et al.

[11] Patent Number: 4,729,752

[45] Date of Patent: Mar. 8, 1988

[54] TRANSIENT SUPPRESSION DEVICE

[75] Inventors: Andrew J. Dawson, Jr., Harrisburg; James M. English, Coplay; Richard P. Hepner, Marietta; John P. Kling, Mt. Joy, all of Pa.

[73] Assignee: AMP Incorporated, Harrisburg, Pa.

[21] Appl. No.: 758,712

[22] Filed: Jul. 26, 1985

[51] Int. Cl.[4] ..... H01R 13/66

[52] U.S. Cl. ..... 439/620; 333/185; 361/56

[58] Field of Search ..... 339/147 R, 147 P; 333/181, 182, 183, 184, 185; 361/56, 91

[56] References Cited

U.S. PATENT DOCUMENTS

| | | | |
|---|---|---|---|
| 3,452,252 | 6/1969 | Mapham | 361/55 |
| 4,020,430 | 4/1977 | Vander Heyden | 339/147 R |
| 4,070,084 | 1/1978 | Hutchison | 339/143 R |
| 4,106,839 | 8/1978 | Cooper | 339/143 R |
| 4,144,509 | 3/1979 | Boutros | 339/147 R |
| 4,198,613 | 4/1980 | Whitley | 333/181 |
| 4,330,166 | 5/1982 | Cooper et al. | 339/143 R |
| 4,365,282 | 12/1982 | Brainard | 361/56 |
| 4,407,552 | 10/1983 | Watanabe et al. | 339/147 R |
| 4,553,114 | 11/1985 | English et al. | 333/185 |
| 4,563,659 | 1/1986 | Sakamoto | 333/182 |
| 4,580,866 | 4/1986 | Hagner | 339/147 R |
| 4,582,385 | 4/1986 | Couper et al. | 339/147 R |
| 4,600,256 | 7/1986 | Anttila | 339/147 R |
| 4,660,907 | 4/1987 | Belter | 339/147 R |

FOREIGN PATENT DOCUMENTS

| | | |
|---|---|---|
| 0024193 | 12/1980 | European Pat. Off. . |
| 3311410 | 10/1983 | Fed. Rep. of Germany . |
| 2119182 | 11/1983 | United Kingdom . |

OTHER PUBLICATIONS

"Suppress EMP at the Interface with Versatile Diode Device", ITT Cannon/Global Connection, Spring 1984, p. 7.

*Primary Examiner*—Gil Weidenfeld
*Assistant Examiner*—Gary F. Paumen
*Attorney, Agent, or Firm*—Katherine A. Nelson; Anton P. Ness

[57] ABSTRACT

A transient suppression device for use in an electrical connector is disclosed. The device is comprised of a dielectric substrate means having conductive path means thereon, electrical terminal means disposed on said substrate means and transient suppression means for electrically connecting said electrical terminal means and said conductive path means. Said device suppresses voltages outside a specified level as they are conducted through said terminal means thus protecting the connector from power surges.

14 Claims, 17 Drawing Figures

TRANSIENT SUPPRESSION DEVICE

FIELD OF THE INVENTION

This invention relates to electrical connectors and more particularly to electrical connectors providing protection against electromagnetic interference, radio frequency interference and especially against power surges.

BACKGROUND OF THE INVENTION

Electrical circuitry often must be protected from disruptions caused by electromagnetic interference (EMI) and radio frequency interference (RFI) entering the system. EMI energy can be generated outside of as well as inside the system and can occur anywhere in the electromagnetic spectrum. External EMI energy is an undesired conducted or radiated electrical disturbance that can interfere with the operation of electronic equipment, while internal EMI energy is the unwanted noise or unwanted interference generated by electrical or electronic circuitry within a system.

RFI is now used interchangeably with EMI but generally is limited to interference in the radio communication band. Connectors are particularly susceptible to EMI energy because of the numerous contact areas and openings for cable and external electrical contacts. The art, however, has developed sophisticated electrical connectors having substantial shielding effectiveness against EMI/RFI energy.

Another type of electromagnetic radiation, however, was observed with the development of nuclear explosives. The nuclear explosion, and in some circumstances large scale chemical explosions, produces a sharp surge (large impulse-type) of radio frequency (long wave length) electromagnetic radiation. Unlike EMI/RFI which are localized effects, the intense electric and magnetic fields created by electromagnetic pulse (EMP) energy can damage unprotected electrical and electronic equipment over a wide area. EMP energy consists of a broad spectrum of energies delivered in a fraction of a second. Peak field strengths can reach tens of kilovolts per meter within nanoseconds. These intense pulses induce high voltages and currents which generate a variety of complex electrical events within a system. Damage can range from a momentary interruption of operation to total overload and burn-out of electronic circuits. Multiple pulses of electromagnetic energy generates more damage since electronics can experience local damage from a first pulse which degrades performance and degrades the device or circuits, so that the following pulse results in the complete destruction.

Within every new generation of electronics more components are packed into smaller spaces which makes the circuits more susceptible to EMP damage. This high device packaging-density inhibits the ability to the circuit to conduct away the heat which results from the typical intense, high voltage and current flows generated by an EMP. As a result, there is an increased demand for electrical connectors having protection against EMP and EMI energy threats.

In addition there is also need to protect electronic equipment from power surges owing to electrostatic discharges (ESD). The high voltage generated by ESD can damage voltage sensitive integrated circuits.

One means to protect against EMI, RFI, ESD and EMP energy is by the use of shielding. One such shielding means is disclosed in U.S. Pat. No. 4,330,166. This patent discloses the use of a conductive spring washer seated in the plug portion of the connector so as to make electrical contact with the receptacle portion of the connector when the plug and receptacle are mated. One washer thus provides shielding for a multitude of electrical circuits. For adequate protection, it is essential therefore that there be no break in the continuity of the shielding.

Other means for protecting against power surges include the use of additional specialized circuitry within equipment, such as voltage variable resistors.

It is an object of the present invention to provide a transient suppression device for use with a variety of connectors. It is a further object to include means that can be used to protect each individual circuit from any transient signal. Furthermore, it is an object to provide a minimum inductance ground path thus assuring minimum response time.

It is also an object to provide a transient suppression means that is to be used inside an electrical connector.

SUMMARY OF THE INVENTION

The present invention is directed to a transient suppression device for use in an electrical connector. The device includes a dielectric substrate means having conductive path means thereon, electrical terminal means disposed on said substrate means and transient suppression means electrically connected between said electrical terminal means and said conductive path means for suppressing voltages outside a specified level as they are conducted through said terminal means. The device as disclosed herein can be incorporated within many standardized connectors thus enabling users to provide EMP protection by simply replacing an existing connector with a protected connector.

A transient suppression means for protecting individual circuits on circuit boards or for retrofitting existing connectors is disclosed in copending U.S. patent application Ser. No. 758,711 entitled "Transient Suppression Assembly" and filed concurrently herewith.

Some of the objects and advantages of the invention having been stated, others will appear as the description proceeds when taken in conjunction with the accompanying drawings.

DETAILED DESCRIPTION OF THE PREFERRED EMBODIMENTS

Figure 1:
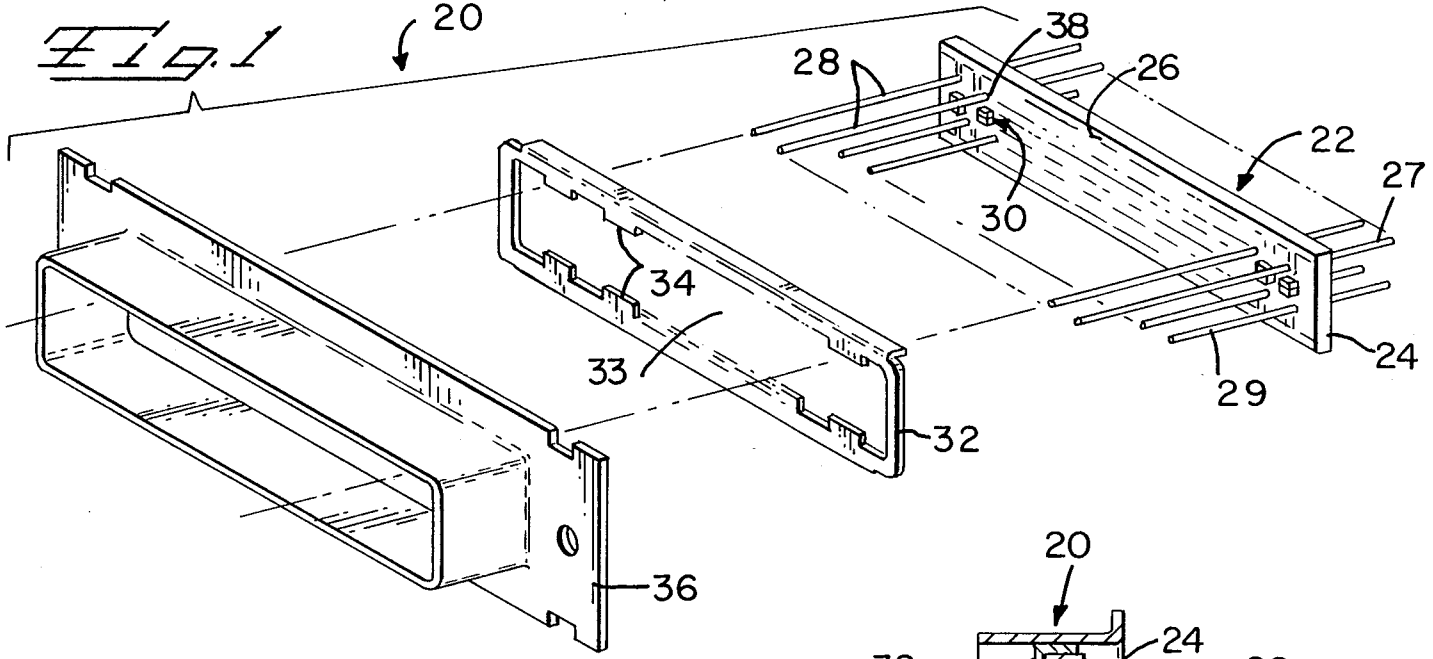
FIG. 1 is an exploded perspective view of a connector subassembly having a transient suppression device therein.
Figure 2:
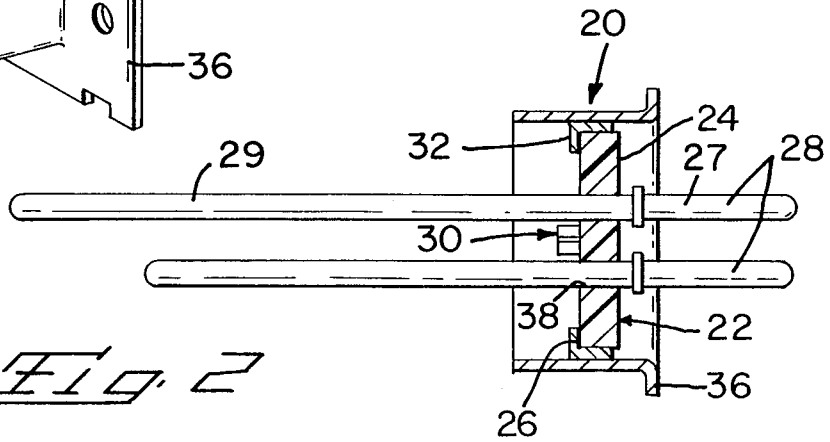
FIG. 2 is a longitudinal section view of the subassembly of FIG. 1.
Figure 3:
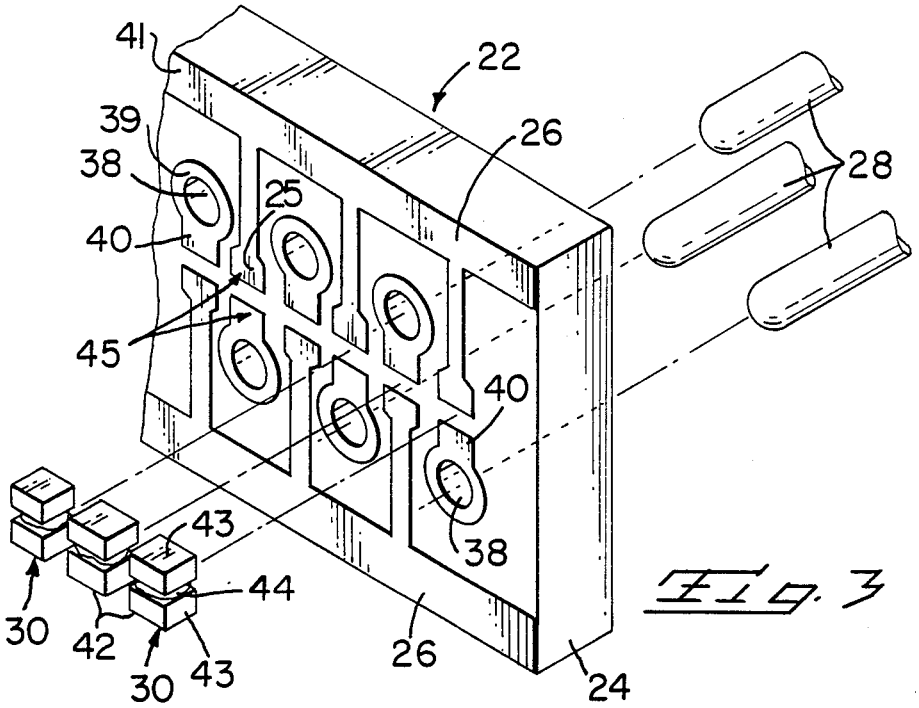
FIG. 3 is an exploded fragmentary view of the transient suppression device.
Figure 4:
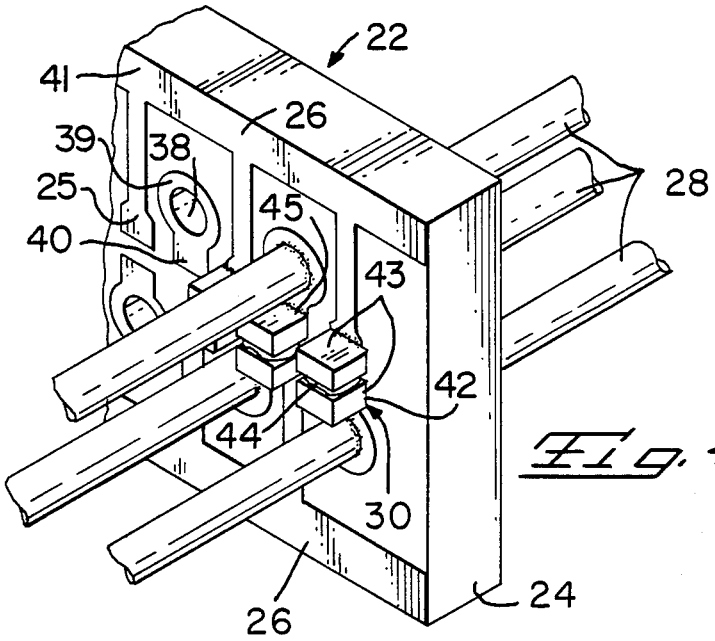
FIG. 4 is a fragmentary perspective view of the assembled device of FIG. 3.

Referring to FIGS. 1, 2, 3, 4, connector subassembly 20 is comprised of a transient suppression device 22, a grounding plate 32 and a shield member 36. The transient suppression substrate means or device 22 is comprised of a planar member or substrate 24 having ground conductive means 26 thereon, electrical terminal means 28, conductive path means having conductive first portions 39 along respective passageways 38 and second portions or pads 40 on a first major side of substrate 24 adjacent thereto, and transient suppression means 30. In the preferred embodiment the electrical terminal means is a plurality of pin terminals which pass through terminal passageways 38 in the substrate 24. Said terminals have contact sections on a first end 27 and a second end 29. Terminals 28 are in electrical engagement with respective first portions of the conductive paths extending along and around the terminal passageways 38. The transient suppression means in the preferred embodiment is a bi-directional diode 42 comprising two unidirectional diodes 43 which have been soldered together at 44. The conductive path means 26 is a grounding conductor. The transient suppression members are secured to the first major side of substrate 24 by being soldered at 45 to and between ground portions 25 of ground conductive means 26 and respective conductive pads 40. Each transient suppression means 30 is made to provide a specific voltage value. The unidirectional diodes 43 are oriented before they are soldered together so that protection is provided for positive and negative voltage surges. The transient suppression means, therefore, conducts current associated with voltages beyond the predetermined value to ground thus protecting the electrical connectors in which the subassembly 20 is used. The subassembly 20 is assembled by placing a grounding plate 32 with grounding fingers 34 extending therefrom against the first major side of substrate 24 so that the grounding fingers 34 engage a ground conductive surface area 41 along the first major side of substrate 24 and commoned with ground portions 25 of ground conductive means 26. The ground plate 32 has an opening 33 therein through which pass the second ends 29 of terminals 28. The subassembly 20 is completed by attaching a metal shield member 36 over the ground plate 32 and transient suppression device 22. As is shown particularly in FIG. 2, the ground plate 32 is in contact with the conductive means 26 and the shield member 36 is in contact with the ground plate 32.

It is to be understood that grounding may also be achieved by forming detents in the shield member 36 that will engage the ground conductive means on the substrate 24 thus eliminating the need for the grounding plate 32. The transient suppression device 22 made in accordance with this invention enables one to protect each individual circuit within a system and also allows the voltage control to be different for each circuit within the system.

It is to be further understood that pin terminals are used for purposes of illustration only. A variety of terminal means as known in the art may be used.

Figure 5:
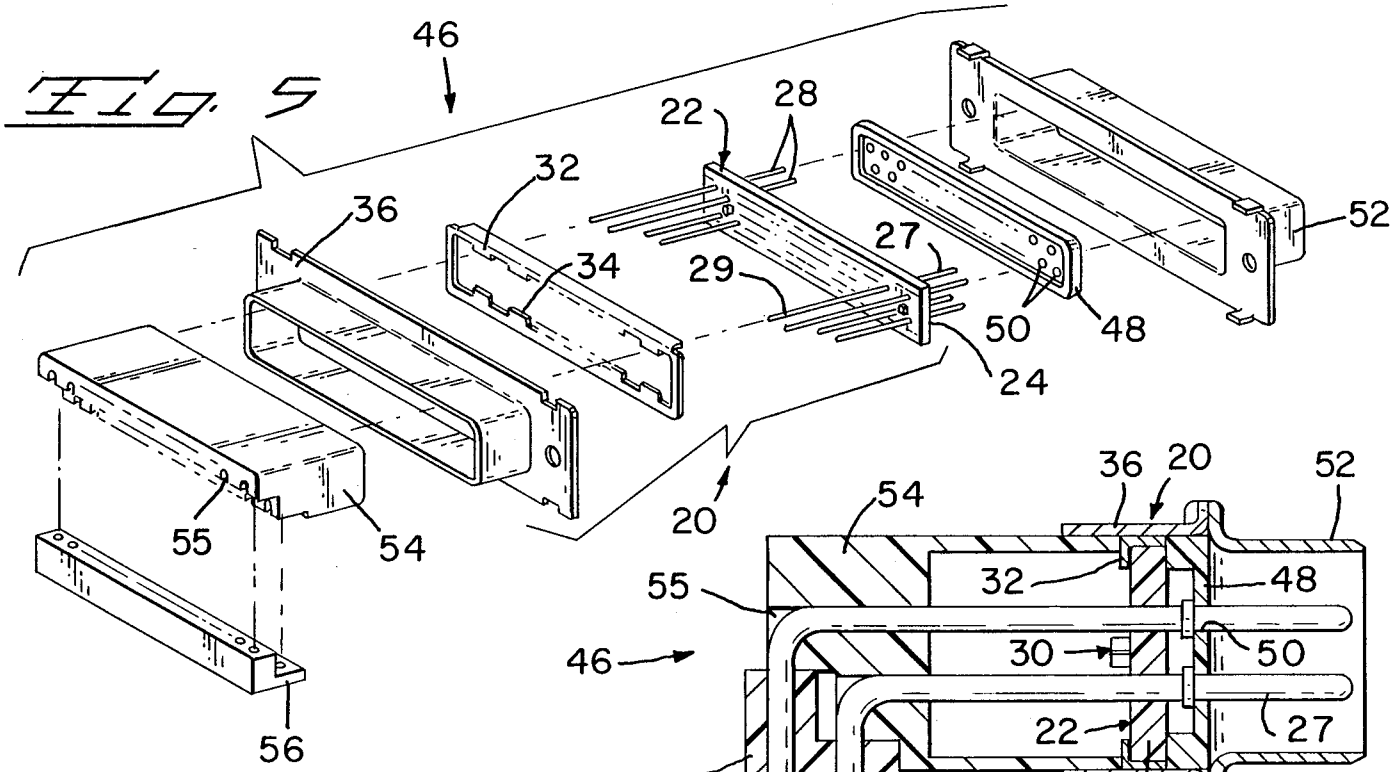
FIG. 5 is an exploded perspective view of an electrical connector having a transient suppression device therein.
Figure 5A:
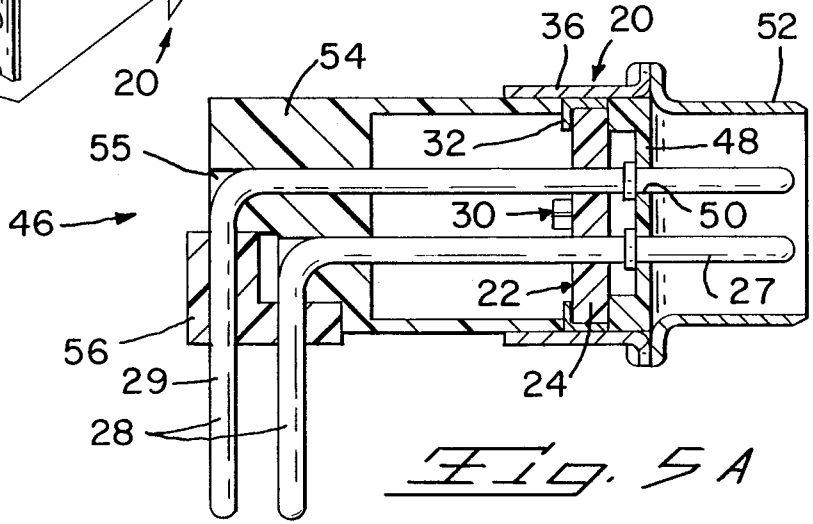
FIG. 5A is a longitudinal section view of the assembled connector of FIG. 5.

Referring now to FIGS. 5 and 5A, the transient suppression device 22 is intended to be used within electrical connectors such as 46. A housing member 54 having passageways 55 for accepting terminal means 28 is inserted into shield member 36 of the subassembly 20 that the terminal means 28 enter the passageways 55 and extend therethrough. In the connector 46 a pin retaining member 56 is also used so that the second ends 29 of terminal means 28 may be bent at right angles to the housing 54. The first ends 27 of the terminal means 28 are inserted into a dielectric cover member 48 having openings 50 therein. The first ends 27 pass through the openings 50 and extend therefrom. Front shield member 52 is attached to the shield member 36 of the transient suppression subassembly 20.

Figure 6:
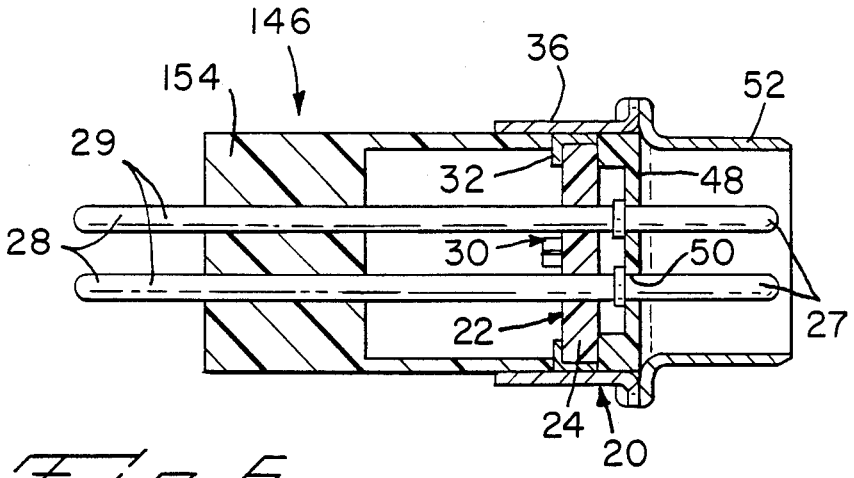
FIG. 6 is a longitudinal section view of an alternative embodiment of connector having the transient suppression device therein.

FIG. 6 shows an alternative embodiment 146 of an electrical connector. In this embodiment the second ends 29 of the terminal means 28 extend through the housing 154 but are not bent at right angles when they exit the housing.

Figure 7:
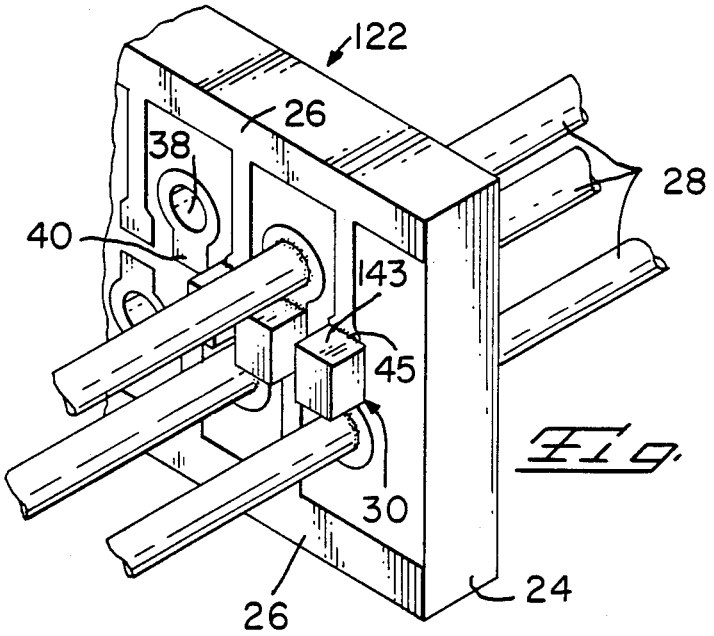
FIG. 7 is a fragmentary perspective view of an alternative embodiment of the transient suppression device using unidirectional diodes.
Figure 8:
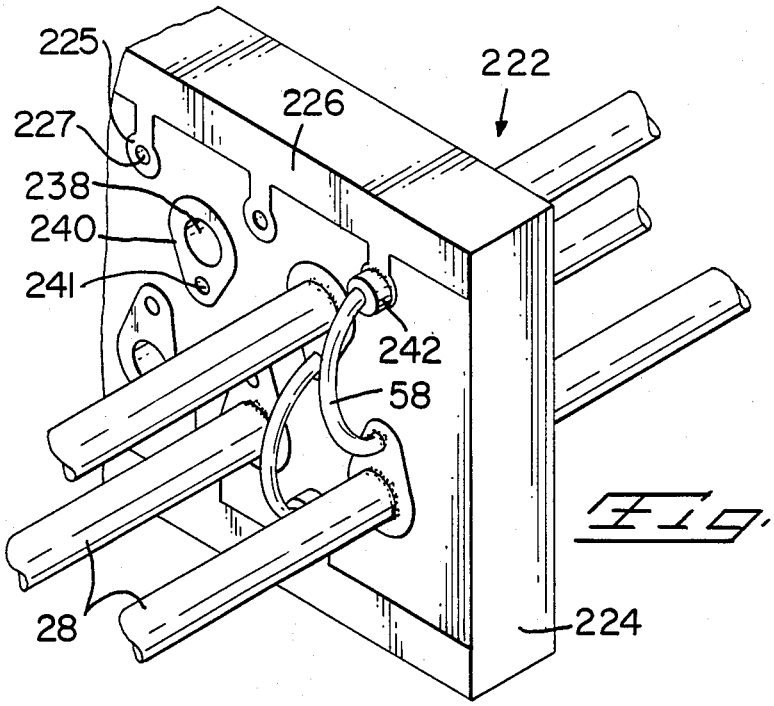
FIG. 8 is a fragmentary perspective view of an alternative embodiment of the device using leaded diodes.
Figure 8A:
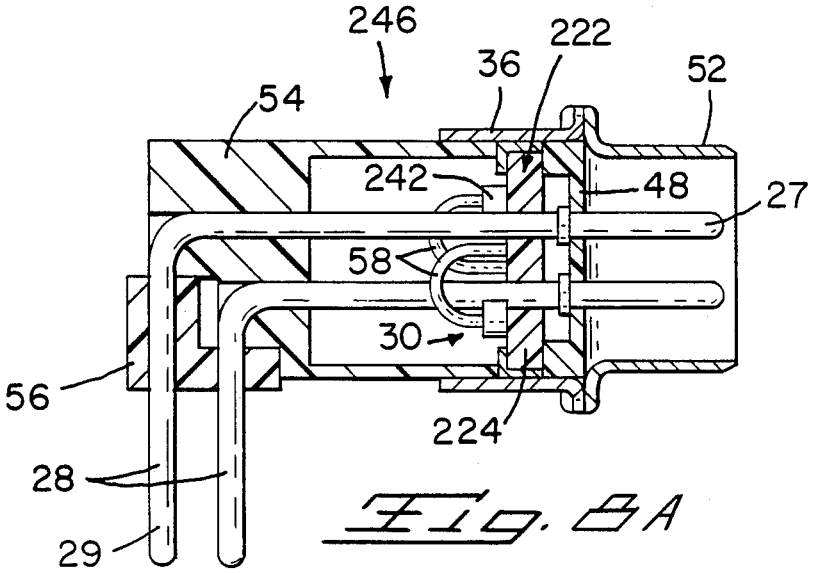
FIG. 8A is a longitudinal section view of an electrical connector having the device of FIG. 8.

FIG. 7 shows an alternative embodiment 122 of the transient suppression device in which the transient suppression means 30 is comprised of a unidirectional diode 143 which is soldered at 45 to substrate 24 in electrical engagement with a conductive pad 40 and a ground portion 25. The device made in accordance with this embodiment 122 will therefore protect the circuit from voltages in one direction only. FIGS. 8 and 8A show a further alternative embodiment 222 of the transient suppression device. In this embodiment the transient suppression means 30 are leaded diodes 242. The diode 242 has leads 58 which are inserted into respective apertures 227,241 and are soldered to the conductive pad 240 adjacent a terminal passageway 238 in substrate 224 and to the associated ground portion 225 of ground conductive means 226. FIG. 8A shows a section view of connector embodiment 246 which utilizes the leaded diode transient suppression device 222.

Figure 9:
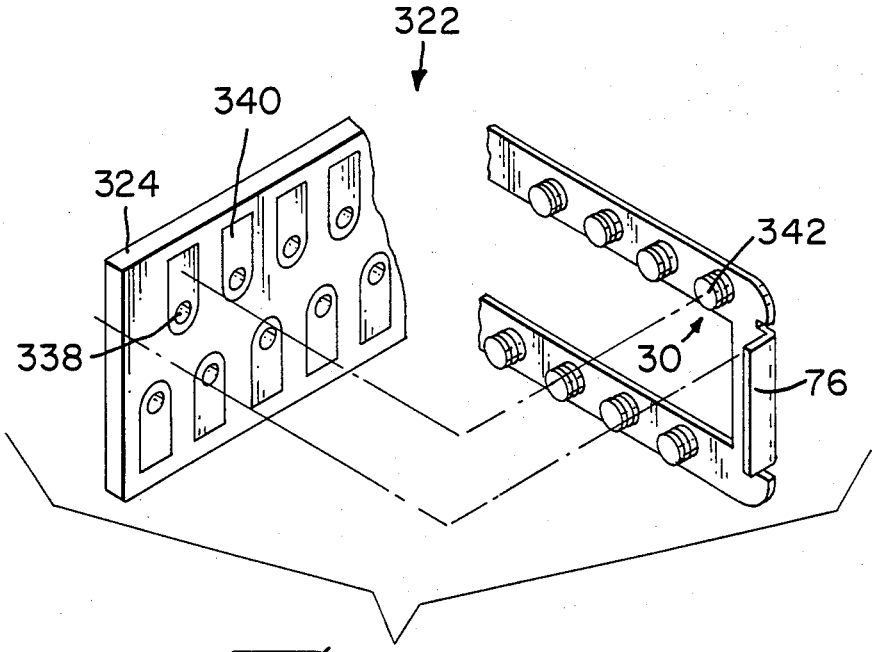
FIG. 9 is a fragmentary exploded view of a further alternative embodiment of the transient suppression device in which the diodes are mounted to a ground plate.
Figure 9A:
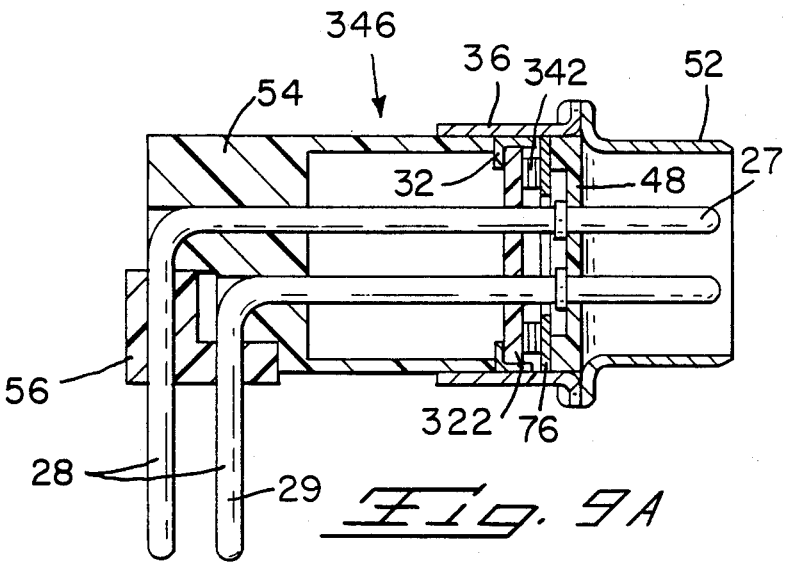
FIG. 9A is longitudinal section view of a connector having the device of FIG. 9.

FIGS. 9 and 9A show a further alternative embodiment 322 of the transient suppression device in which diodes 342 are mounted to a metal ground plane 76 so that the diodes will electrically engage the conductive paths 340 surrounding the terminal passageways 338 in substrate 324 when the ground plane 76 is attached to substrate 324. In assembling this embodiment 346, as shown in FIG. 9A, substrate 324 is sandwiched between ground plate 32 and ground plane 76, with ground plane 76 shown electrically engaged with shell 36.

Figure 10:
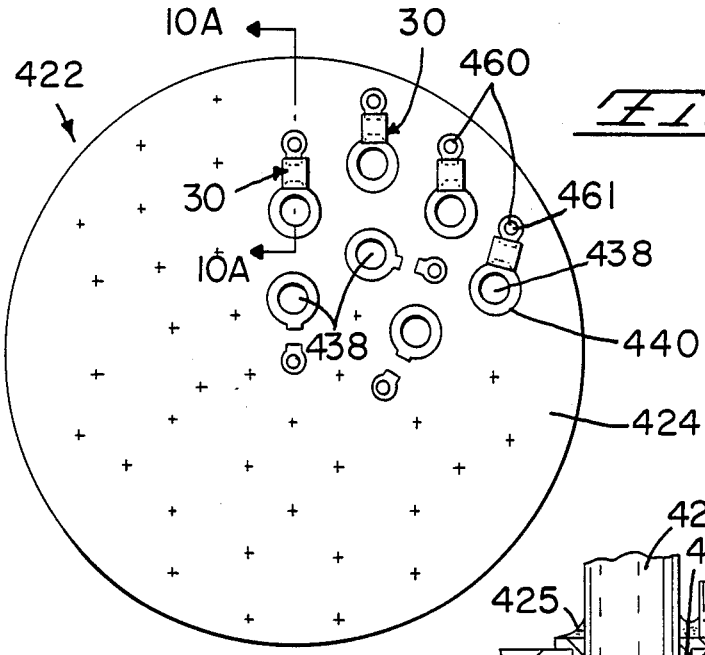
FIG. 10 is a top view of a device for use in a circular connector.
Figure 10A:
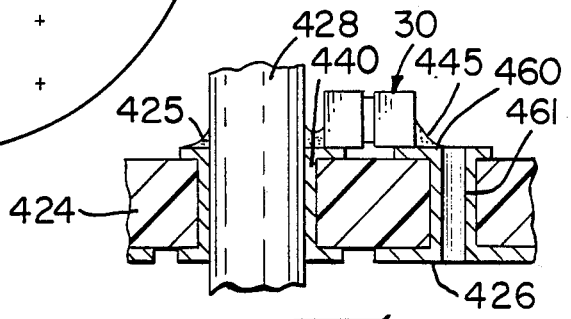
FIG. 10A is a fragmentary longitudinal section view taken along line 10A—10A in FIG. 10.
Figure 10B:
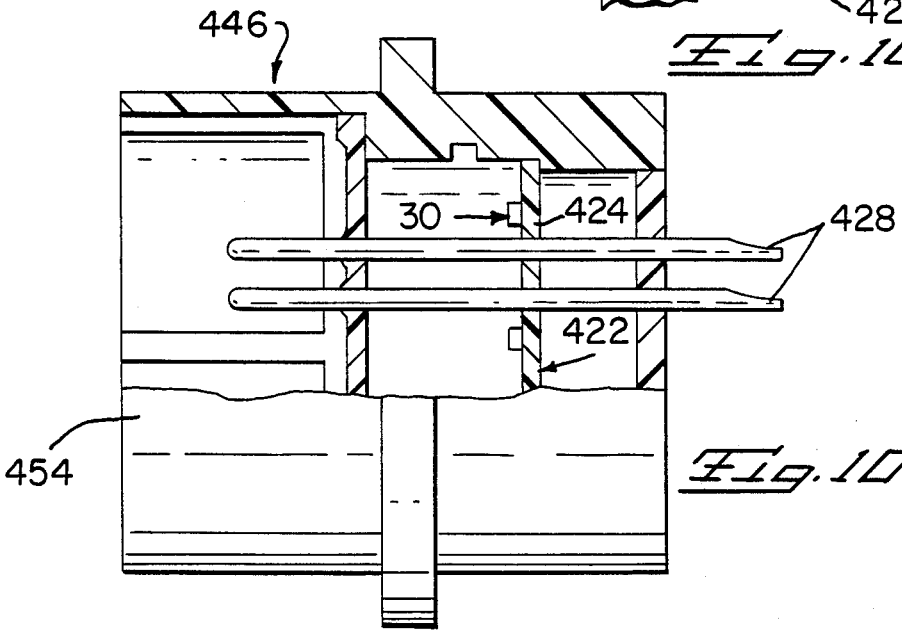
FIG. 10B is a longitudinal section view of a connector using the device of FIG. 10.

FIGS. 10, 10A and 10B illustrate further embodiment 422 of the transient suppression device for use in a circular connector 446. In this embodiment the transient suppression means 30 are bi-directional diodes which are mounted at 445 to one side of a circular substrate 424. The diodes interconnect respective conductive paths 440 surrounding terminal passageways 438 means and ground portions 460 surrounding a plated-through holes 461 which electrically interconnect conductive areas 60 to the ground conductive surface area 426 on the second major side or on the under surface of the circular substrate 424. FIG. 10A shows a cross-sectional view of a portion of substrate 424 illustrating that the terminal means 428 are joined with solder 425 to the substrate 424. The transient suppression means 30 is soldered at 445 to conductive path 440 and the a plated-through hole 461 to interconnect with the ground conductive surface area 426. FIG. 10B shows a fragmentary section view of a typical circular connector 446 showing the position of the transient suppression device 424 within connector housing 454.

Figure 11:
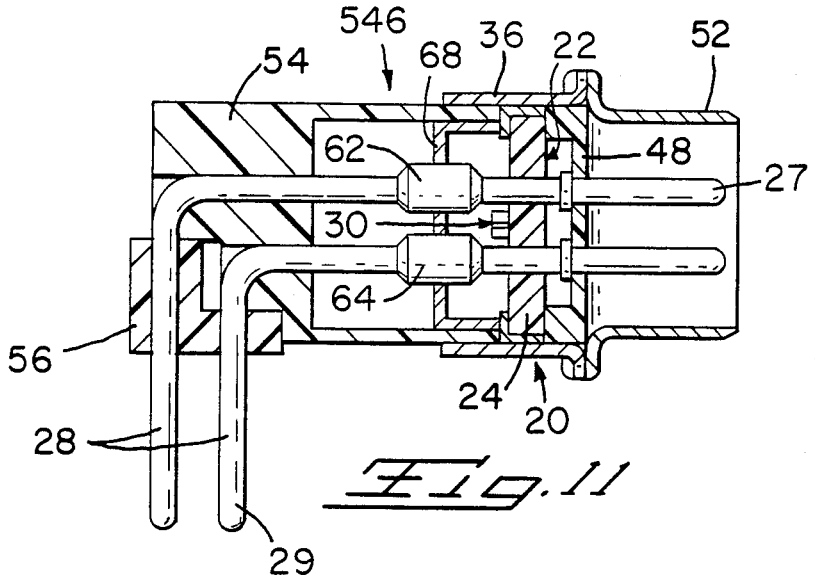
FIG. 11 is a longitudinal section view of a filtered electrical connector having the transient suppression device therein.
Figure 12:
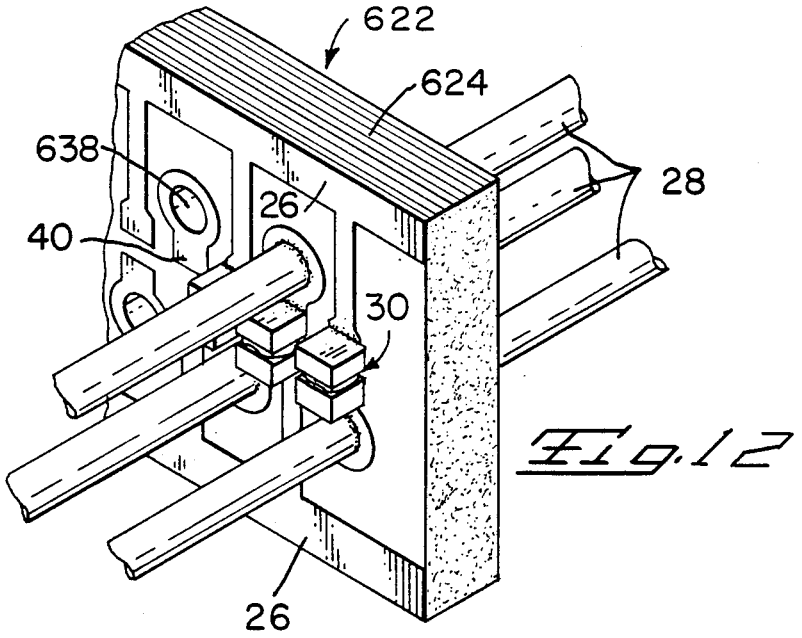
FIG. 12 is a fragmentary perspective view of a further embodiment of transient suppression device.

FIGS. 11 and 12 show the use of the transient suppression device in conjunction with filter means in electrical connectors. FIG. 11 shows a section view of further embodiment 546 of an electrical connector in which the transient suppression device 22 is inserted forward of the filter means 62. Filter means 62 is comprised of a ground plate 68 and filter sleeves 64. Filter sleeves are preferably of the type illustrated in U.S. Pat. No. Re. 29,258. FIG. 12 shows use of transient suppression device 622 having a planar filter element 624 as the substrate member. Terminal means 28 are inserted through openings 638 in said filter element 624. Transient suppression means 30 are soldered onto the surface of planar filter element 624.

The invention disclosed herein provides superior performance in the suppression of transient voltages. The use of surface mounted transient suppression means in close proximity to the individual terminal members provides a short, minimum inductance ground path for any transient signal. Minimum response time is thus assured.

In the drawings and specification, there have been set forth preferred embodiments of the invention, and although specific terms are employed, they are used in a generic and descriptive sense only, and not for purposes of limitation.

What is claimed is:

1. An electrical connector comprising:

transient suppression substrate means including a planar member having at least one terminal receiving passageway extending therethrough from a first major side to a second major side, said substrate means including a corrsponding at least one conductive path means each having a first portion adjacent a respective said at least one terminal receiving passageway and adapted to be electrically connected to a respective corresponding at least one terminal extending through said at least one passageway, said substrate means further including ground conductive means at least including a corresponding at least one ground portion associated with and electrically separated from a respective second portion of said corresponding said at least one conductive path means and substantially laterally spaced from said at least one terminal receiving aperture, said ground conductive means further including a ground conductive surface area commoned with said at least one ground portion and adapted to be engaged by ground means, said substrate means further including a corresponding at least one transient suppression means each electrically connected to a said second portion of said corresponding at least one conductive path means and said at least one ground portion of said ground conductive means;

a corresponding at least one electrical terminal member secured in a respective said at least one terminal receiving passageway in electrical connection with said first conductive path portion, each said at least one terminal member including first and second contact sections extending outwardly from said first major side and said second major side respectively of said substrate means for electrical engagement with corresponding first and second contact means;

means for housing said transient suppression substrate means and said at least one electrical terminal member and adapted to permit electrical engagement of said first and second contact means with said first and second contact sections of each said at least one terminal member; and means for grounding said ground conductive means of said transient suppression substrate means, whereby upon establishment of a ground connection with said ground conductive means, voltages outside a specific level are suppressed as they are conducted through each said at least one terminal.

2. An electrical connector, comprising:

transient suppression substrate means including a planar member having a plurality of terminal receiving passageways extending therethrough from a first major side to a second major side, said substrate means including a like plurality of conductive path means each having a first portion adjacent a respective said terminal receiving passageway and adapted to be electrically connected to a respective terminal extending through said passageway, said substrate means further including ground conductive means at least including ground portions associated with and electrically separated from respective second portions of said conductive path means and substantially laterally spaced from said terminal receiving apertures, said ground conductive means further including a ground conductive surface area commoned with said ground portions and adapted to be engaged by ground means, said substrate means further including a like plurality of transient suppression means each electrically connected to a said second portion of a respective said conductive path and a said associated ground portion of said ground conductive means;

a like plurality of electrical terminal members secured in respective said terminal receiving passageways in electrical connection with said first conductive path portions, each said terminal member including first and second contact sections extending outwardly from said first major side and said second major side respectively of said substrate means for electrical engagement with corresponding first and second contact means;

means for housing said transient suppression substrate means and said electrical terminal members and adapted to permit electrical engagement of said first and second contact means with said first and second contact sections of each said terminal member; and means for grounding said ground conductive means of said transient suppression substrate means, whereby upon establishment of a ground connection with said ground conductive means, voltages outside a specific level are suppressed as they are conducted through said terminals.

3. An electrical connector as set forth in claim 2 wherein said planar member is dielectric, a said second portion of said conductive path and a said associated ground portion are disposed on a common surface of said planar member, and one of said transient suppression means is secured to said planar member in electrical connection with said second conductive path portion and said associated ground portion.

4. An electrical connector as set forth in claim 3 wherein said transient suppression member is a surface mountable diode.

5. An electrical connector as set forth in claim 3 wherein a lead receiving aperture extends through each of said second conductive path portion and said associated ground portion, and said transient suppression member is a leaded diode having first and second leads secured in respective said lead receiving apertures.

6. An electrical connector as set forth in claim 3 wherein said planar member is dielectric and second said conductive path portions and said associated ground portions are disposed on one of said first major side and said second major side of said planar member, said ground conductive surface area is disposed on the other of said first major side and said second major side, and a conductive aperture through said planar member electrically interconnects each said ground portion and said ground conductive surface area.

7. An electrical connector as set forth in claim 2 wherein said ground conductive means is a metal member parallel to and spaced from one of said first and said second major sides of said planar member, said second conductive path portions are disposed on said one of said first and said second major sides, and said transient suppression means are secured between and to said planar member and said metal member in electrical connection with said second conductive path portions and said metal member.

8. An electrical connector as set forth in claim 2 wherein said ground means is a metal member disposed peripherally around said substrate means and secured thereto in electrical engagement with said ground conductive surface area thereof, said housing means includes a conductive shell, and said metal member is secured and electrically engaged with said conductive shell.

9. An electrical connector as set forth in claim 2 wherein said housing means includes dielectric portions forwardly and rearwardly from said substrate means and having a plurality of passageways through which extend portions of said plurality of electrical terminal members proximate said first and second contact sections thereof.

10. The electrical connector as defined in claim 9 further comprising shielding means in electrical engagement with said ground conductive means.

11. The electrical connector as defined in claim 2 further comprising filter means in electrical engagement with said electrical terminal members.

12. The electrical connector as defined in claim 11 wherein said filter means comprises filter sleeve members disposed on respective electrical terminal members and in electrical engagement with said ground means.

13. The electrical connector as defined in claim 11 wherein said filter means comprises a planar filter member.

14. The electrical connector as defined in claim 2 wherein said planar member is a filter member.

* * * * *